US005161687A

United States Patent [19]

Kornell et al.

[11] Patent Number: 5,161,687

[45] Date of Patent: Nov. 10, 1992

[54] RECLOSABLE LABEL PACKAGE

[75] Inventors: Michael J. Kornell, McFarland; William T. Graham; Kevin Retelle, both of Madison, all of Wis.

[73] Assignee: Four Lakes Label and Printing Company, Inc., Madison, Wis.

[21] Appl. No.: 847,459

[22] Filed: Mar. 6, 1992

[51] Int. Cl.[5] ..... B65D 73/00

[52] U.S. Cl. ..... 206/447; 206/460; 206/459.5

[58] Field of Search ..... 206/460, 447, 449, 459; 40/299, 661, 642; 283/101, 109

[56] References Cited

U.S. PATENT DOCUMENTS

| | | | |
|---|---|---|---|
| 2,271,946 | 2/1942 | Miller | 206/460 X |
| 2,679,928 | 6/1954 | Bishop, Jr. et al. | 206/460 |
| 2,783,172 | 2/1957 | Avery | 206/447 |
| 3,153,868 | 10/1964 | Jones | 40/299 |
| 3,338,395 | 8/1967 | Silverstein | 206/460 X |
| 3,347,361 | 10/1967 | Dindeke | 206/460 X |
| 3,361,252 | 1/1968 | Wise | 206/460 X |
| 3,854,229 | 12/1974 | Morgan . | |
| 3,974,311 | 8/1976 | Cherrin . | |
| 4,159,586 | 7/1979 | Blum . | |
| 4,204,706 | 5/1980 | Blum et al. . | |
| 4,281,762 | 8/1981 | Hattemer | 206/460 |
| 4,400,419 | 8/1983 | Laczynski . | |
| 4,523,776 | 6/1985 | Barber . | |
| 4,528,055 | 7/1985 | Hattemer . | |
| 4,968,540 | 11/1990 | Linsenbigler . | |
| 5,139,136 | 8/1992 | Eickhoff et al. | 206/460 |

*Primary Examiner*—William I. Price
*Attorney, Agent, or Firm*—Quarles & Brady

[57] ABSTRACT

A reclosable and resealable label package is provided which minimizes the amount of packaging necessary for retail display and marketing of labels. The package includes a set of labels formed within a label layer which has a lateral portion surrounding the layers. A top cover sheet is releasably adhered to the label layer only in the lateral portions thereof so that it can be peeled back to allow access to the labels and resealed to reclose the package. The provision for the transparent top cover sheets both obviates the need for any ancillary packaging and provides clear access through the cover sheet so that marketing indicia can be printed directly on the label layer and still be available for viewing by the consumers who may wish to examine the attributes of the product.

11 Claims, 2 Drawing Sheets

RECLOSABLE LABEL PACKAGE

FIELD OF THE INVENTION

The present invention relates to labels, in general, and relates, in particular, to a reclosable or resealable package in which adhesive-backed labels may be marketed and stored.

BACKGROUND OF THE INVENTION

It has become a common item of retail commerce to sell packages of labels which have adhesive attached to their back surface. Such adhesive-backed labels are typically mounted on a backing sheet, which is coated with a release coating, so that the labels can be peeled off of the backing sheet for use. Such labels have many common uses for office and personal organization, for communication and for correspondence, and for coding and product labeling in manufacturing and industrial environments. In addition, labels can be made for many fanciful or amusement purposes, including fanciful labels for use by children. Many kinds, styles, and variants of such labels are currently sold at retail in the U.S.

One aspect of the marketing of labels is that often the packaging for the labels can actually exceed the cost of the goods sold within the package. It has become increasingly uncommon for loose items to be stocked and sold in the modern retail sales environment. Products such as labels must therefore either be boxed, or packaged, in some way so as to be in convenient units which are resistant to tampering by consumers, and which include within the unit enough product so as to be marketable at a price worth the cost of inventory and stocking of the units in a retail establishment. Thus, the two most typical current ways for packaging labels for current retail sale are in boxes and in shrink-wrap packaging. Both the costs of a box to sell labels in, and the cost of appropriate shrink-wrapping or other seal plastic wrapping of labels, can approximate or even exceed the actual cost of the labels within the package themselves. In such a case, the cost of the packaging is disproportionate to the total cost of the labels, as compared to the cost of packaging to the cost of other goods sold at retail. In other words, for labels sold at retail, the consumer pays a disproportionate cost for the packaging, as opposed to the cost of the goods which they are purchasing.

Various systems have been previously suggested for covering adhesive-backed labels with clear plastic layers, for a variety of purposes, usually related to protection of the label from wear or further destruction. For example U.S. Pat. No. 3,854,229 discloses a transparent plastic film located on the label which is intended to be relaminated over the label, so as to protect it from the environment or from later marking. Name tag label systems have been described, such as in U.S. Pat. Nos. 4,159,586 and 4,204,706 which use multiple layered systems, including a transparent overlayer, which is intended to be placed over a name tag after a name is written on it. The purpose of the transparent label is to prevent further alteration of the name tag once the individual's name has been written on it. No system is currently known for packaging labels for retail sale to the consumer which does not incorporate extraneous and unneeded packaging materials which approach the cost of manufacturing of the labels themselves.

SUMMARY OF THE INVENTION

The present invention is summarized in that a series of labels with adhesive backing are formed on a backing sheet from which they are removably attached, the backing sheet has non-label portions extending laterally from the labels, a transparent removable cover layer is placed all over all of the labels and is adhesively attached to that portion of the backing which surrounds the labels, the label also having suitable indicia so as to be adaptable for point of sale display, and the transparent cover sheet being adhesively attached to the backing sheet out on the portion which is lateral to the labels such that the cover sheet can be removably released from the label package to allow access to the labels, without ever adhesively contacting the labels themselves.

It is an object of the present invention to provide a system for packaging labels for point-of-sale retail display which incorporates no extraneous or unneeded packaging materials, while still providing all of the packaging necessities for modern retail display and sale.

It is yet another object of the present invention to provide a resealable label package which provides a transparent protective cover layer for labels in the package, with the cover layer being removably attached to the package to allow access to the labels while still protecting the unused labels.

It is yet another object of the present invention to provide a resealable label package which is convenient and economical to manufacture, to display for sale, and to use by the ultimate consumer.

Other objects, advantages, and features of the present invention will become apparent from the following specification when taken in conjunction with the accompanying drawings.

DESCRIPTION OF THE PREFERRED EMBODIMENT

Figure 1:
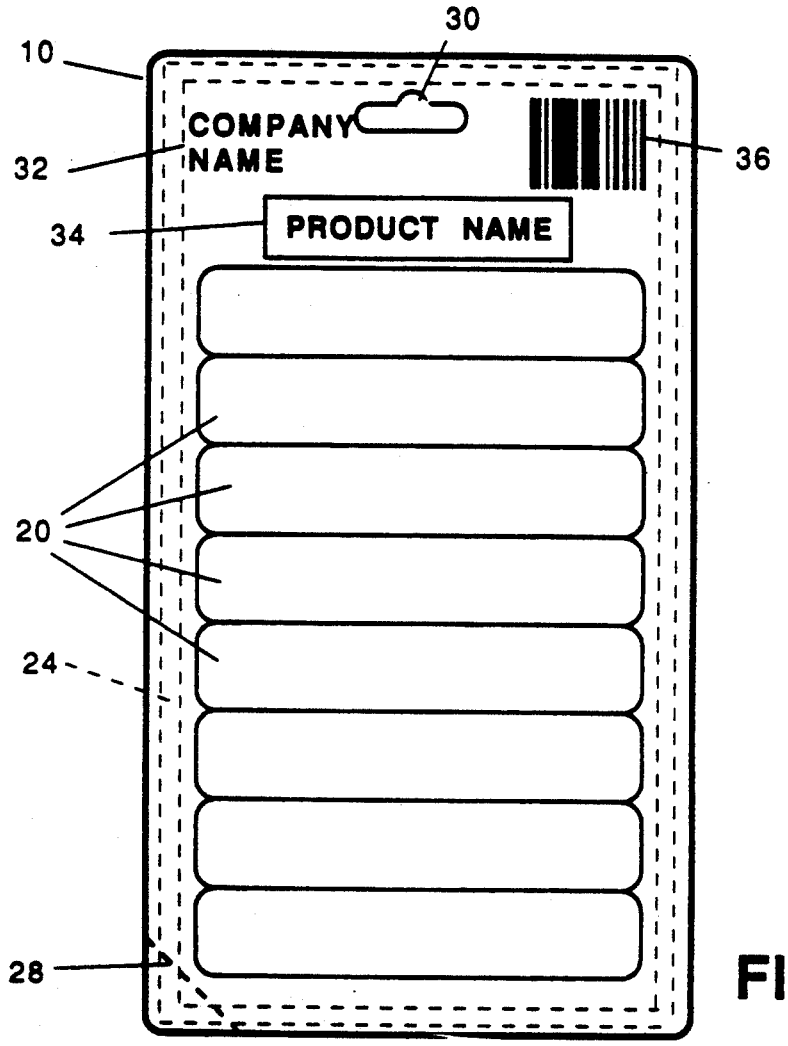
FIG. 1 is a front elevation view of a reclosable label package constructed in accordance with the present invention.

Shown in FIG. 1, and generally illustrated at 10, is a reclosable label package constructed in accordance with the present invention. The reclosable label package 10 is intended to serve two purposes. The first purpose is to efficiently, and economically, package labels in such a fashion that they can be delivered to a store ready for retail use and display without the need for further packaging. A second objective is to provide a package in which the labels can be resealably or reclosably enclosed for storage for later use. Both of these objectives are achieved by this product, as will be more fully described below.

Figure 2:
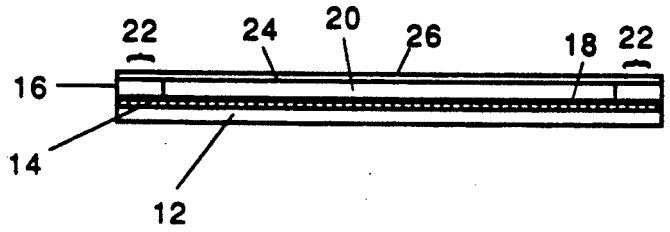
FIG. 2 is a cross-sectional view showing the layers contained within the product of FIG. 1.

The layers that form the reclosable label package 10 of FIG. 1 can also be viewed in the cross-sectional view of FIG. 2. The foundation of the unit is a base layer or backing sheet 12 formed from a flat piece of stock material. The material for the backing sheet 12 can be any suitable paperboard, or other suitable planar sheet material, which has sufficient weight and rigidity so as to serve as a backing sheet upon which labels can be carried. In the single sided embodiment of FIGS. 1 and 2, the back face of the backing sheet 12 can be printed with appropriate indicia and/or designs so as to be pleasing in appearance when utilized in a retail environment. The function of the base layer 12 is to serve as a base for the entire package, and thus it should provide sufficient rigidity so that the reclosable label package 10 is easy to handle and will remain flat when stored for extended periods of time.

On the front face of the base layer 12 is disposed a release coating 14. The release coating 14 is an adhesive release agent, of a type of which there are several well known to the art, such as a silicon coating. The release coating may be applied to all, or only part, of the top face of the base layer 12.

Disposed on top of the release coating 14 is a label layer 16, on the bottom of which has been placed an adhesive coating 18. The label layer 16 has been die cut, so as to form within it a plurality of labels 20. However, the die cuts are arranged so that the labels 20 are formed on the interior of the label layer 16 thereby leaving a lateral portion 22 of the label layer 16 located outwardly from the labels 20 created within the label layer 16. The label layer 16 itself can be formed from a suitable stock material, of any of various weights and styles. The labels can be highly glossy, semi-glossy, matte, and in addition to paperboard can be polyester, vinyl foils, or various other forms of sheet material which can be used as labels. The labels can be printed with various graphic designs, and die cut into a wide variety of shapes and sizes. The adhesive layer 18 coated on the lower face underneath the label layer 16 is an adhesive coating of a type normally used to adhere removable labels to other surfaces. The adhesive type will preferably be permanent, but could also be removable, repositionable, or a specific adhesive adapted for particular applications, such as cold temperature. The adhesive layer 18 serves to adhere the label layer 16 to the backing 12, for sale and storage. The adhesive for the adhesive layer 18 and the release coating 14 are selected so that the labels 20 can be easily removed from the backing, so that they can be applied to a particular object which is sought to be labeled.

On the top of the label layer 16 is a pattern of cover layer adhesive 24. The cover layer adhesive 24 is formed from an adhesive which forms a resealable and releasable adhesion to the top face of the stock material forming the label layer 16. The cover layer adhesive 24 is laid in a particular pattern on the top face of the label layer 16, such that the cover layer adhesive 24 is placed only on the lateral portions 22 of the label layer 16, and not on any of the labels 20. The pattern of application of the cover layer adhesive layer 24 in the embodiment of FIG. 1 is illustrated by dashed lines, forming a rectangle on the product just inboard of the outside edge of the product itself. The adhesive for the cover layer adhesive 24 can be any of a wide variety of releasable and resealable adhesives known to those of ordinary skill in the art.

On top of the cover layer adhesive 24 is disposed a cover layer 26. The cover layer 26 is formed from a clear, transparent stock material which is selected so as to be releasably adhered by the cover layer adhesive 24 to the top face of the label layer 16. The stock material for the cover layer 26 is clear, so that the products layers lying under it may easily be seen even when the cover layer 26 is in place. The cover layer 26 may sometimes be printed with appropriate indicia describing the product.

Shown in FIG. 1 are several other aspects of the product design contributing to its ease of use and efficiency. A corner tab 28 is provided in one corner of the package 10 to serve as a handle for raising the cover layer 26. The corner tab 28 can be formed as a die cut corner or as an adhesiveless corner tab. If formed as a die cut corner, a die cut corner is provided through the base layer 18, and the label layer 16, but not through the cover sheet 26. The die cut corner thus serves as a starting point from which the cover layer 26 can be peeled away from the product. By bending the die cut line for the corner tab 28, and tearing it from the base layer 12 and the label layer 18, the cover layer 26 can be peeled back from the product allowing access to the labels 20 carried in the product underneath the cover sheet 26. The corner portions of the base layer 18 and label layer 16 which still adhere to the cover sheet 26 can be used as a sort of handle, by which the cover sheet 26 can be peeled off of the package 10 and then replaced thereon. It is specifically intended that the cover sheet 26 be removable and replaceable so that the cover sheet 26 can be peeled back to allow access to the labels, after which the cover sheet 26 can be returned to its original position, in which it seals again, by virtue of the cover layer adhesive 24, back to the label layer 16.

Alternatively, and preferably, the corner tab 28 is formed by a corner portion of the cover sheet 26 under which no adhesive 24 is placed. The cover layer adhesive 24 is simply laid in a pattern which omits one corner, thus creating the corner tab 28. The user simply peels back the cover sheet 26 by pulling on this corner tab 28 and replaces it in the same manner.

Also shown in FIG. 1 is a die cut hanger hole 30, formed through all the layers of the product and adapted and shaped so that the product can be hung, in exactly this configuration, from suitable point of sale peg-type displays. Suitable indicia for point of sale display of the product, including a company name 32, a product name 34, and a universal product code 36, are also formed on the front of the package 10. In the preferred embodiment, all of the suitable indicia for point of sale display are printed on the front face of the label layer 16, which will often be printed in any event if printing on the labels contained within the package is desired. The marketing indicia on the top face of the label 16 is visible through the transparent cover sheet 26. If desirable for a particular application, the indicia could also be printed on the top face of the cover sheet 26 rather than on the label layer 16. If labels are formed on only one side of the backing sheet 12, some of the indicia, such as universal product code 36 in particular, could be located on the rear face of the base sheet 12 rather than on the top face.

In its operation, the resealable label package 10 of FIGS. 1 and 2 provide an efficient, economical and highly functional system for the delivery of labels prepackaged for retail sale, and a package that minimizes excess costs and maximizes benefit to the consumer who purchases the product. Note that no external wrapping is required for the package 10 to be suitable for retail display and sale. By virtue of the transparent cover sheet 26, the product is already wrapped in a convenient and efficient manner, and using material well known and accepted to consumers. Since the cover sheet 26 is formed as an integral part of the product, there is no secondary wrapping operation needed, and the cost of the packaging does not form an inappropriate cost of the overall package. Since retail display of products requires that there be a place in which marketing indicia, such as company name, product name, price marking, and universal product code, be displayed for access to the public, and to employees of the retail establishment, a place for providing all of those indicias is provided on the package 10 in a way that they are readily accessible without further manipulation. The provision for the hanging cut-out 30 ensures that the product can be hung on normal retail sale peg displays often used for cards or other similar label type items. Thus no additional packaging whatsoever is necessary for this product as displayed for retail, and the product is, in essence, ready for use as sold without the need for unpackaging or separations of any kind.

The package also serves as a reclosable and resealable package in which labels may be stored. To gain access to the labels in the package, the user simply separates the corner cut 18 and peels back a portion of the cover sheet 26 to allow access to the labels. One or more labels 20 can then be removed from the package. The user then simply replaces the cover sheet 26 back over the extent of the label layer 16, and the cover sheet is adhered to the label layer 16 by the cover layer adhesive 24. Note that the cover layer adhesive 24 is specifically positioned on the lateral portions 22 of the label layer 16 so that the cover sheet 26 never adheres to the labels themselves. In this way, the front of the labels are maintained clean and free from any adhesive or other objectionable materials, while still providing a removable transparent cover for the package during its sale and storage. Although in the embodiment of FIG. 1, the pattern of the cover layer adhesive 24 is arranged so that it does not extend over the indicia portions 32, 34, and 36, in other embodiments the pattern of the cover layer adhesive 24 could be arranged so that it could extend over those areas, provided only that transparent adhesive was used for the cover layer adhesive 24 itself.

Figure 3:
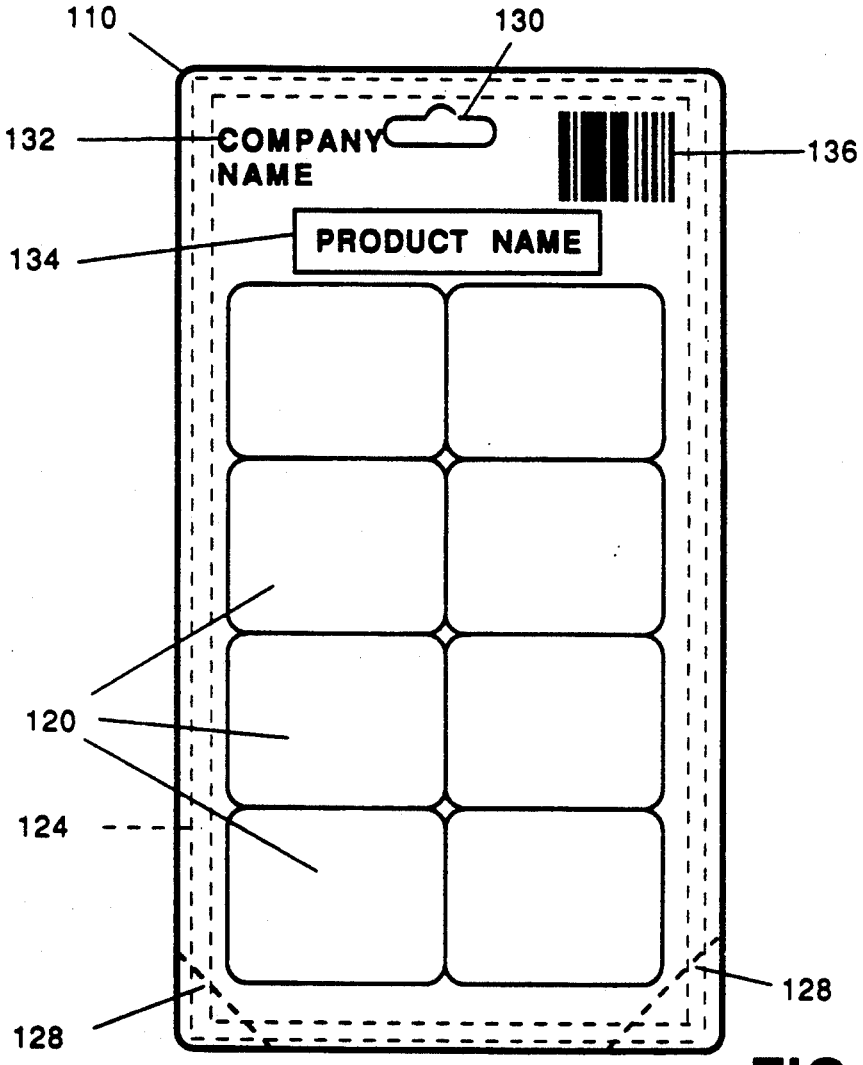
FIG. 3 is a front elevational view showing an alternative embodiment of a label package with a part of the cover layer removed.
Figure 4:
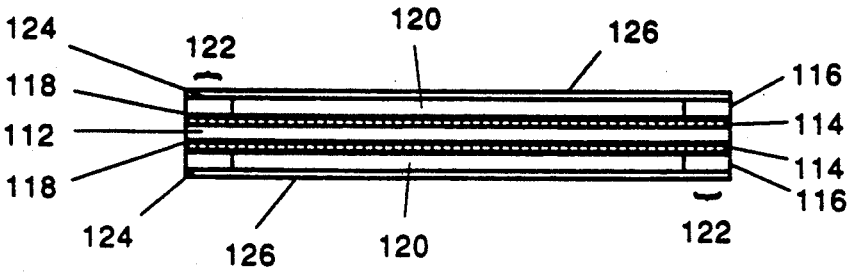
FIG. 4 is a cross-sectional view taken on the line 4—4 in FIG. 3.

Shown in FIGS. 3 and 4 is an alternative embodiment of the present invention. In the reclosable label package 110 indicated in FIGS. 3 and 4, the part corresponding to those parts shown in the reclosable label package 10 of FIGS. 1 and 2 are designated with reference numerals 100 greater than those of the reference numerals designated in FIGS. 1 and 2. The difference in the reclosable package 110 of FIGS. 3 and 4 is that in this package labels are disposed on both sides of the backing sheet 112. As can be seen by the cross-sectional view in FIG. 4, the backing sheet 112 is located in the center of the package and a release coating 114 is applied to both the top and lower faces of the backing sheet 112. On top of the release coatings 114 are placed respective label layers 116 each of which again also includes a set of die cut labels 120 formed in the center thereof and a lateral portion 122 surrounding the labels 120. An adhesive coating 118 is applied to the bottom of the label layers 116 so as to adhere them to the release coatings 114 until it is desired to remove the labels. A pair of top cover sheets 126 are applied to opposite sides of the package and a pair of top cover adhesive layers 124 are arranged in patterns on the lateral portions 122 of the label layers 116 so that the top cover sheets 126 will be adhered to the upper and lower faces of the package.

In essence the label package of FIGS. 3 and 4 allows for twice the number of labels to be marketed in a single convenient, sealed, and reclosable package. Since the labels 120 are disposed on both sides of the backing sheet 112, the number of labels contained within a single package sold as a retail unit is maximized. By providing the top cover sheets 126 on both faces of the package, both sets of labels 120 are provided with a protective covering as to seal them from tampering or other defacement and a resealable cover is provided over both sets of labels 120 by virtue of the transparent cover sheets 126.

In the embodiments of FIGS. 3 and 4, there must be two of the corner tabs 128 located at two different corners of the package and preferably on opposite corners. If die cuts are used for the corner tabs 128, one of the die cuts is from the top face of the package and the other of the corner cuts is from the bottom or lower face of the package. Each of the die cuts would extend through one of the transparent cover sheets 126, through the backing sheet 112 and through both of the label layers 116, but not through the other top cover sheet 126. If the adhesiveless version of the corner tabs 128 is used, adhesive would be omitted from the area of one corner on each of the two sides of the package. Thus, each of the corner tabs 128 serves as a handle or a holding portion for a respective opposite one of the two transparent cover sheets 126. Thus one can be lifted from the top of the package, as can be seen in FIG. 3, while the other can be lifted from the rear face of the package. This way access can be had to the labels on both the top and rear faces of the package while allowing the package to be conveniently sealed on both of its surfaces for storage and later use.

It is to be understood that the present invention is not limited to the particular embodiments and details illustrated herein, but embraces all such modified forms of the invention as come within the scope of the following claims.

We claim:

1. A reclosable label package comprising a backing sheet of stock material with a top face;

a release coating applied to the top face of the backing sheet;

a label layer with adhesive applied to it joined to the top face of the backing sheet over the release coating, the label layer including a plurality of die-cut labels and a lateral portion surrounding the labels;

a top cover adhesive applied to the lateral portion of tne iabel layer, the labels being free of the top cover adhesive;

marketing indicia printed on the label layer so that suitable marketing information is provided to a consumer; and a transparent top cover sheet removably and resealably adhered by the top cover adhesive to the label layer, the marketing indicia being visible to the consumer through the top cover sheet.

2. A label package as claimed in claim 1 wherein the package has a hanging cut-out formed therethrough so that it may be mounted on a peg display in a retail display.

3. A label package as claimed in claim 1 where there is a corner tab on the top cover sheet adapted so that it may be lifted to lift the top cover sheet from the package.

4. A label package as claimed in claim 3 wherein the corner tab is a die-cut corner cut through the backing layer and the label layer but not the top cover sheet.

5. A label package as claimed in claim 3 wherein the corner tab is formed by a corner portion of the top cover sheet under which no top cover adhesive is placed.

6. A label package as claimed in claim 1 wherein the top cover adhesive surrounds the labels.

7. A reclosable label package suitable for retail display to consumers comprising a backing sheet of stock material having a top face and a lower face;

a release coating applied to each of the top face and the lower face of the backing sheet;

a label layer with adhesive applied to it joined to each of the top face and the lower face of the backing sheet over the release coating, the label layers each including a plurality of die-cut labels and a lateral portion surrounding the labels;

a top cover adhesive applied to the lateral portion of each of the label layers, the labels being free of the top cover adhesive;

marketing indicia printed on at least one of the label layers so that suitable marketing information is provided to the consumers; and a transparent top cover sheet removably and resealably adhered by the top cover adhesive to each of the label layers, the marketing indicia being visible to the consumers through the top cover sheet.

8. A reclosable label package as claimed in claim 7 wherein the package has a hanging cut-out formed therethrough so that it may be mounted on a peg display in a retail display.

9. A reclosable label package as claimed in claim 7 wherein there is a corner tab on each of the top cover sheets so that they may be manually manipulated.

10. A reclosable label package as claimed in claim 9 wherein each corner tab is formed by a corner of the respective top cover sheet under which no top cover adhesive is placed.

11. A reclosable label package as claimed in claim 9 wherein the corner tabs are two die-cuts cut through the backing sheet and both of the label layers, each of the die-cuts cut through a one of the cover sheets so that either cover sheet can be peeled back to allow access to the labels.

* * * * *